US010053805B1

(12) United States Patent
Connelly

(10) Patent No.: US 10,053,805 B1
(45) Date of Patent: Aug. 21, 2018

(54) APPARATUS FOR SECURING KNITTING NEEDLES

(71) Applicant: Justin Connelly, Anacortes, WA (US)

(72) Inventor: Justin Connelly, Anacortes, WA (US)

( * ) Notice: Subject to any disclaimer, the term of this patent is extended or adjusted under 35 U.S.C. 154(b) by 0 days.

(21) Appl. No.: 15/474,701

(22) Filed: Mar. 30, 2017

(51) Int. Cl.
*D04B 3/00* (2006.01)

(52) U.S. Cl.
CPC ..... *D04B 3/00* (2013.01)

(58) Field of Classification Search
CPC ... D04B 3/00; D04B 3/02; D04B 3/04; D04B 3/06
USPC ..... 66/1 R, 1 A
See application file for complete search history.

(56) References Cited

U.S. PATENT DOCUMENTS 369,075 A * 8/1887 Post ..... D04B 17/00 66/1 R
2,930,213 A * 3/1960 Sorlie ..... D04B 3/00 66/1 A
3,019,500 A * 2/1962 Duffin ..... D04B 3/00 24/561
3,438,223 A * 4/1969 Linstead ..... D04B 3/00 66/1 A
3,603,115 A * 9/1971 Elzey ..... D04B 17/04 66/117
D281,118 S * 10/1985 Gakiya ..... D3/26
5,544,764 A * 8/1996 Cima ..... B43M 99/008 211/60.1
D392,180 S * 3/1998 Bilow ..... D8/382
6,449,987 B1 * 9/2002 Poole ..... D04B 3/00 66/1 A
8,602,211 B2 * 12/2013 Sasur ..... B65D 85/24 206/341
2012/0222978 A1 * 9/2012 Sasur ..... B65D 85/24 206/380

* cited by examiner

*Primary Examiner* — Danny Worrell

(57) ABSTRACT

Described herein is an apparatus for securing knitting needles, comprising: an s-shaped or reverse s-shaped body, the body comprising three relatively linear segments of similar length, width and depth, aligned in the same plane, the first segment adjoining the second segment by a curved end disposed opposite a first terminal end of the first portion, and the second segment adjoining a third segment by a curved end, the curved end opposite a second terminal end of the third portion; a plurality of grooves disposed along a portion of the surface of the apparatus body; a plurality of protruding teeth formed where grooves meet; a plurality of needle containment compartments formed by opposing grooves opposite one another along the inner surface, and whereby the compartments are of a size commensurate for securing a knitting needle of a gauge essentially equal to the radius of the compartment formed by the opposing grooves.

6 Claims, 9 Drawing Sheets

APPARATUS FOR SECURING KNITTING NEEDLES

BACKGROUND

Knitting projects often slip off needles while in a bag or purse, or otherwise being stored with the project. Knitting needles become disengaged from the yarn or knots, causing disruption or destruction of a knitting project. Previously, the main solution were rubber tips that fit over the tapered end of the knitting needles. These devices are inferior because not only do stitches slide off over the tips, the rubber tips themselves often slide off. As a result, projects become undone and yarn becomes tangled as a result.

SUMMARY OF THE INVENTION

To prevent knitting projects from sliding off the knitting needles, and to keep the needles neatly together, an apparatus for securing knitting needles has been developed. In one embodiment, the apparatus is an "S" (or reverse "S") shaped device comprising two u-shaped inner channels in opposite, yet substantially parallel orientation to one another, each channel comprising an open end. The surface of the inner channels comprises rounded teeth comprising a series of grooves of uniform or varying size, which are disposed along all or a portion of the inner surface of the channel.

The grooves are disposed on opposite sides of each other along the inner channel thereby creating a plurality of needle slots configured for needle containment, in order to secure a knitting needle in position.

Knitting needles are held in a position between the teeth, enclosed on a side by the grooved surface of the channel. In one embodiment, grooves depth and width dimensions correspond, in part, based on size of knitting needles intended for use with the apparatus. In another embodiment, a portion of the channel surface comprises a gripping mechanism for knitting needles, which further aids to contain knitting needles in a stationary position within the apparatus.

In one embodiment of the invention, grooves are of a size that accommodate knitting needles of a size range of gauges, such as #4 through #11 (standard U.S. sizes). The grooved design allows for knitting needles to be held in position without risk of a knitting project sliding off the needles. Additionally, all surface edges of the grooves forming the teeth are radiused to prevent yarn from catching on or being cut by sharp edges.

Described herein is an apparatus for securing knitting needles, comprising: an s-shaped or reverse s-shaped body, the body comprising three relatively linear segments of similar length, width and depth, aligned in the same plane, the first segment adjoining the second segment by a curved end disposed opposite a first terminal end of the first portion, and the second segment adjoining a third segment by a curved end, the curved end opposite a second terminal end of the third portion, the area surrounded by the first portion and second portion defining a first inner channel comprising an inner surface, and the area surrounded by the second portion and third portion defining a second inner channel comprising an inner surface; a plurality of grooves disposed along a portion of the surface of first inner channel and second inner channel, specifically along a surface of the first portion that faces a surface of the second portion, and along a surface of the second portion that faces the surface of the first portion; also along a surface of the second portion that faces a surface of the third portion, and along the surface of the third portion that faces the surface of the second portion; a plurality of protruding teeth formed where two grooves meet; and a plurality of needle containment compartments formed by opposing grooves opposite one another along the inner surface, and whereby the needle compartments are of a size commensurate for securing a knitting needle of a gauge essentially equal to the radius of the needle containment compartment formed by the opposing grooves. In another embodiment, the protruding teeth have a radius ranging from 0.029-0.046 inches. In another embodiment, the needle compartments formed by alignment of grooves opposite one another have a distance between opposing grooves ranging from 0.069-0.236 inches. In another embodiment, the apparatus comprises two, four, six, eight or ten pair of grooves.

DETAILED DESCRIPTION OF THE INVENTION

Figure 1:
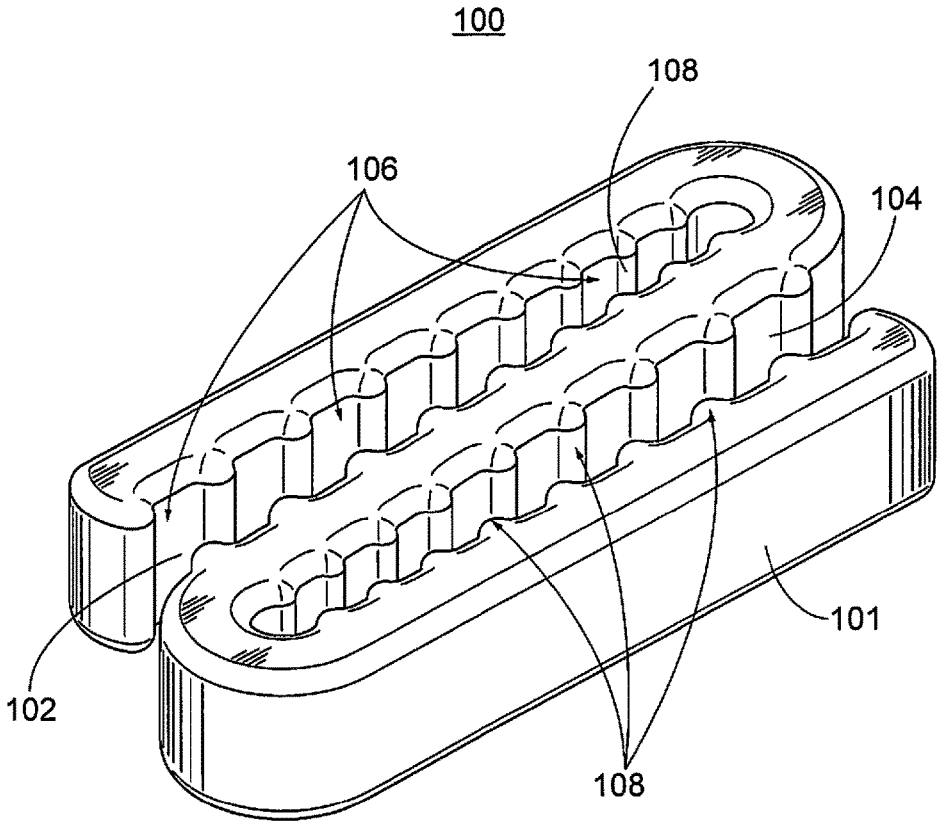
FIG. 1 shows a side perspective view of an apparatus according to one embodiment of the present invention.

In one embodiment, the apparatus of the present invention comprises a body configured of a single piece of semi-rigid synthetic material, such as plastic, further configured with sufficient rigidity to impart grip and tension on knitting needles engaged therewith, yet flexible enough to reduce risk of breakage or fracture of materials when used to engage knitting needles. In one embodiment, the apparatus for holding knitting needles is made of synthetic materials such as plastic, rubber, thermoplastic elastomer, soft metals, or other natural or synthetic polymers, or natural or synthetic filaments, or combinations thereof. In another embodiment, the apparatus is made of recycled and/or natural materials, such as wood, or combinations thereof. In one embodiment, the apparatus is manufactured by a 3D printing method, or by an injection molding method using a mold cavity for the apparatus described herein—depending on the materials used. In one embodiment, the body of apparatus is flexible, if it is desired to allow for adjustment of size and snugness around knitting needles secured in the apparatus. In another embodiment, at least a portion of the apparatus or all or a portion of a surface of the apparatus body comprises a magnetized material or magnetized coating. In yet another embodiment, all or at least a portion of the apparatus comprises a coating layer on the apparatus body in order to impart a smooth finish to prevent fraying or snagging of materials. Coating layer may be clear or of various colors or tints.

In one embodiment, the apparatus for securing knitting needles comprises a body formed of a z-shape or s-shape (depending on the orientation of view). Body may be tubular and may be solid or hollow. Apparatus body is generally comprised of a curvilinear body formed into the general shape of an S or Z, or reverse S or Z (depending on the orientation of view), the curvilinear body comprising three relatively linear segments of similar length, width and depth, aligned in the same plane, with the first portion adjoining the second portion by a curved end disposed opposite the terminal end of the first portion (forming an inverted and substantially u-shaped segment), and the second portion adjoining the third portion by a curved end opposite the terminal end of the third portion (a second inverted and substantially u-shaped segment). The open area between the first portion and second portion (the u-shaped segment) defines a first inner channel, and the open area between the second portion and third portion defines a second inner channel. A plurality of grooves and teeth are disposed along a portion of the surface of inner channel, specifically along a surface of the first portion that faces a surface of the second portion, and along a surface of the second portion that faces the surface of the first portion; also along a surface of the second portion that faces a surface of the third portion, and along the surface of the third portion that faces the surface of the second portion. The resulting arraignment of grooves and teeth form needle containment compartments for securing a knitting needle.

In one embodiment, an apparatus of the present invention has overall dimensions of a length of 2.188 inches, a width/height of 0.998 inches, and a body thickness of 0.375 inches, although other dimensions are envisioned and within the scope of the embodiments presented. In one embodiment, a channel has an average length of 1.67 inches and width of 0.998, although other dimensions are expected based on the dimensions of the overall apparatus body.

The inner surface of channels are incurvate at intervals, forming a striated surface, the striations forming a plurality of depressions (or grooves) separate by teeth formed by the edges of two adjoining grooves. The depressions or grooves may be of various sizes (depth of groove and length, as well as the arc of the groove), as well as the resulting teeth formed on either edge of the groove or depression. In one embodiment, a needle holder comprises a plurality of groove sizes, thereby accommodating a variety of needle gauges.

In one embodiment, teeth protruding from body segments have a radius ranging from 0.029-0.046 inches. In another embodiment, resulting needle compartments formed by alignment of grooves opposite one another have a distance between opposing grooves ranging from 0.069-0.236 inches. In one embodiment, a needle holder device comprises two, four, six, eight or ten pair of grooves. A pair of grooves refers to opposing grooves formed on opposing inner surfaces along the inner surface of the apparatus body, so that the grooves on either end (top and bottom, or side opposite side, depending on orientation) form a circular-shaped needle compartment.

Turning to the figures, there is shown at FIG. 1 a side perspective view of an apparatus 100 according to one embodiment of the present invention. In one embodiment, apparatus 100 is generally comprised of an s-shaped body 101 comprising a first inner channel 102 and second inner channel 104, the channels generally u-shaped with an open end. Along a portion of an inner surface of the inner channels are grooves 106 disposed along the surface, the grooves forming radiused teeth where two grooved meet. Grooves 106 are aligned so that a groove positioned along an inner surface of the u-shaped channel aligns with an opposing groove positioned along the inner surface on an opposing side of the u-shaped inner channel.

Figure 2A:
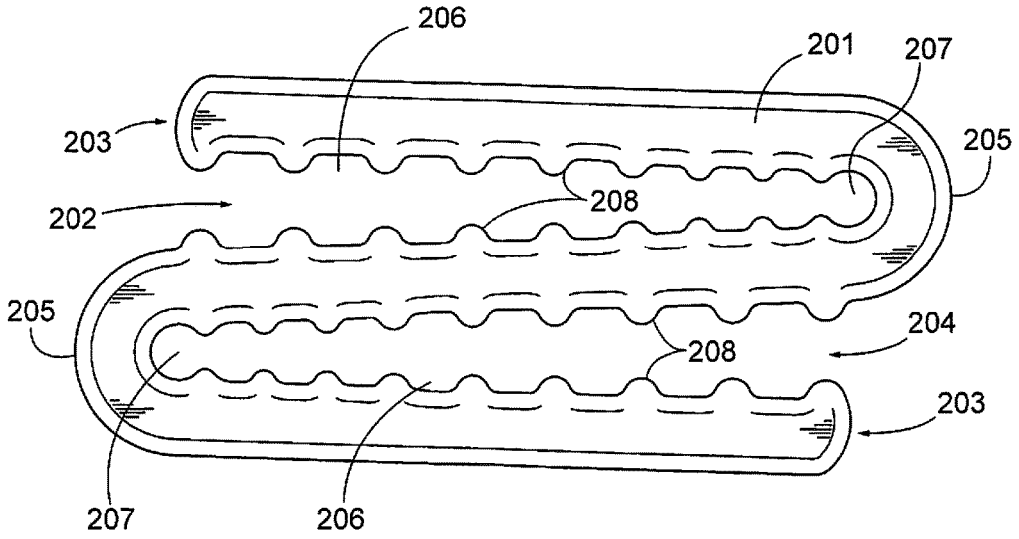
FIG. 2A shows a first top side view of an apparatus according to one embodiment of the present invention.
Figure 2B:
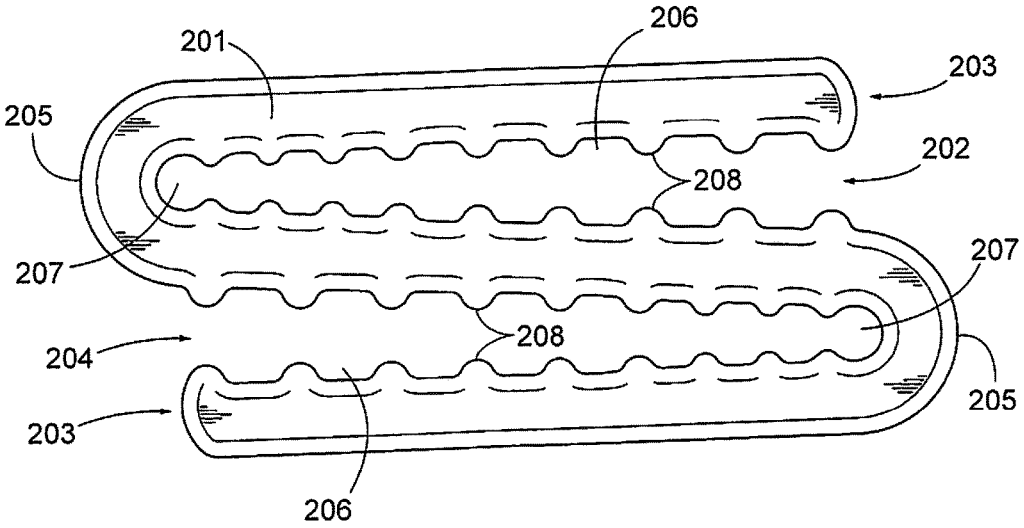
FIG. 2B shows a second top side view of an apparatus according to one embodiment of the present invention.

FIGS. 2A and 2B shows a first (front) and second (back) side view of an apparatus according to one embodiment of the present invention, wherein z-shaped body 201 comprises a terminal end 203 at each end of apparatus and a channel terminus 207 formed from a curved corner 205 of z-shaped body; a first inner channel 202; a second inner channel 204; a plurality of grooves 206; a plurality of radiused teeth 208; and one or more of a needle compartment 210 formed by the arrangement of grooves 206 and radiused teeth 208, wherein the size of the needle compartment is commensurate with a radius (or gauge) of a knitting needle occupying the needle compartment, when placed therein.

Figure 3A:
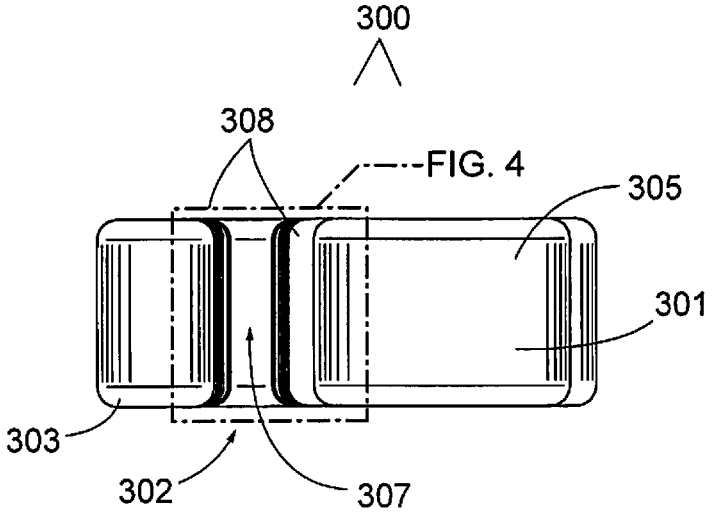
FIG. 3A shows a side view, specifically an inward view into a first inner channel of the apparatus.
Figure 3B:
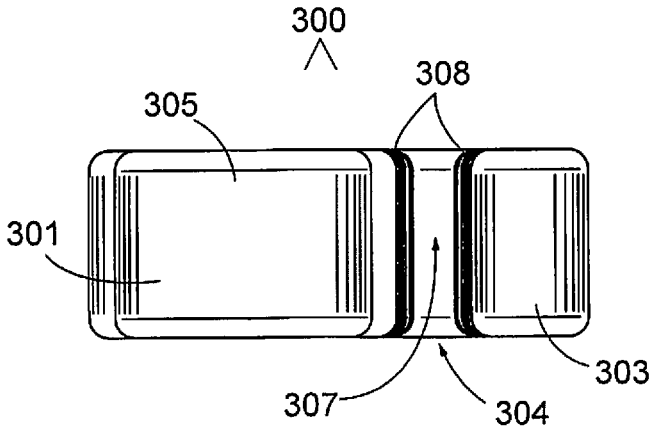
FIG. 3B shows another side view, specifically an inward view into a second inner channel of the apparatus.

FIGS. 3A and 3B shows an inward view into an inner channel of the apparatus 300 toward the channel terminus 307 and showing a side view of radiused teeth 308. Looking inward from the side view, terminal end 303 and curved end 305 of body 301 flank the inner channel 302 (shown in FIG. 3A) and inner channel 304 (shown as reverse in FIG. 3B).

Figure 4:
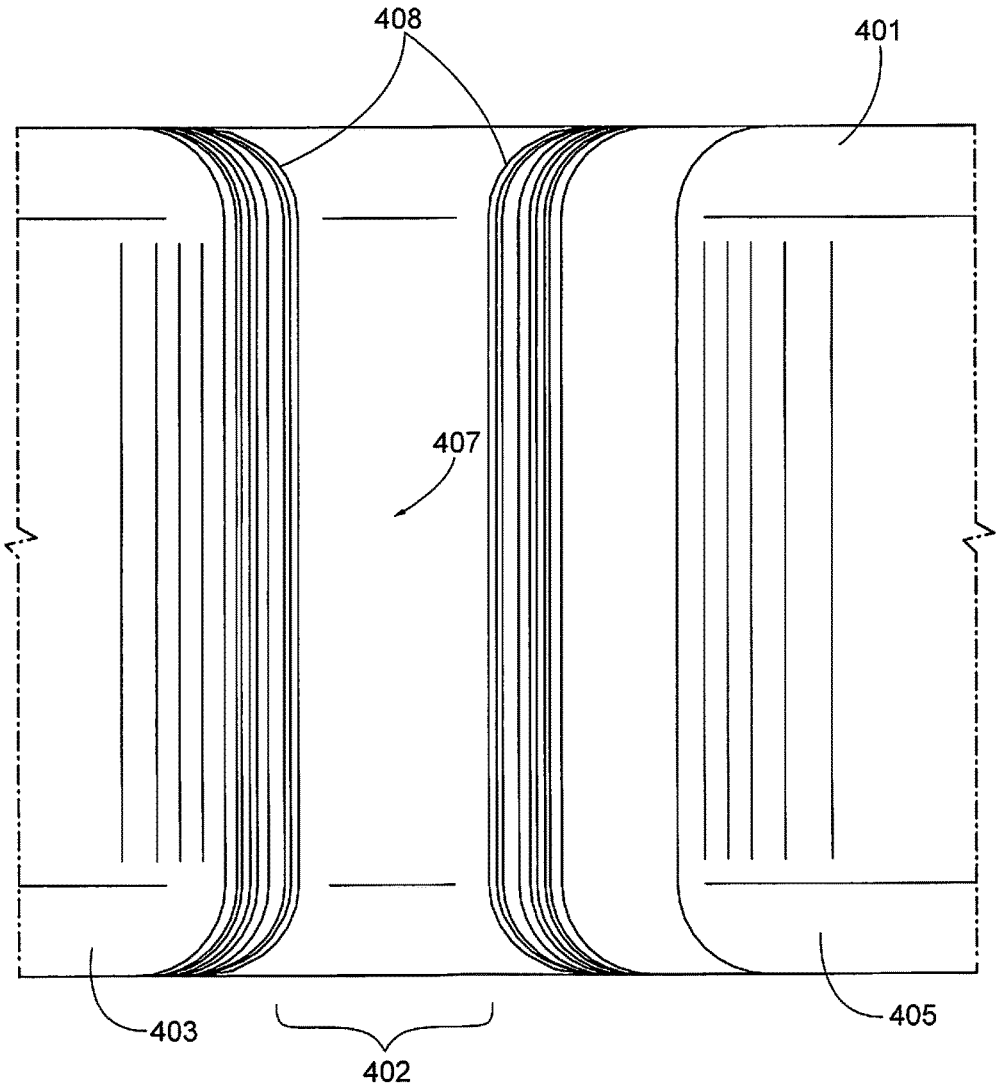
FIG. 4 shows an expanded view of the inward view shown in FIGS. 3A and 3B, showing the radiused edges of the teeth disposed along the surface of apparatus body along an inner channel.

FIG. 4 shows an expanded view of FIG. 3A, showing closer detail of the radiused edges of teeth 308 disposed along the surface of the inner channel, from a side view, looking inward to channel 402 toward the channel terminus 307. Channel 402 is flanked by terminal end 403 and curved end 405 of s-shaped body 401.

Figure 5A:
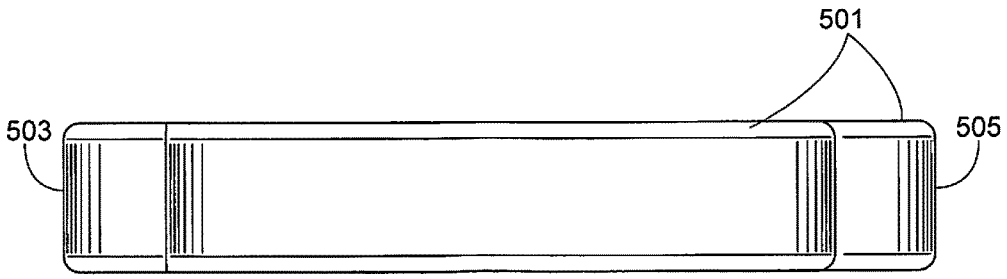
FIG. 5A shows a first side view of an apparatus according to one embodiment of the present invention.
Figure 5B:
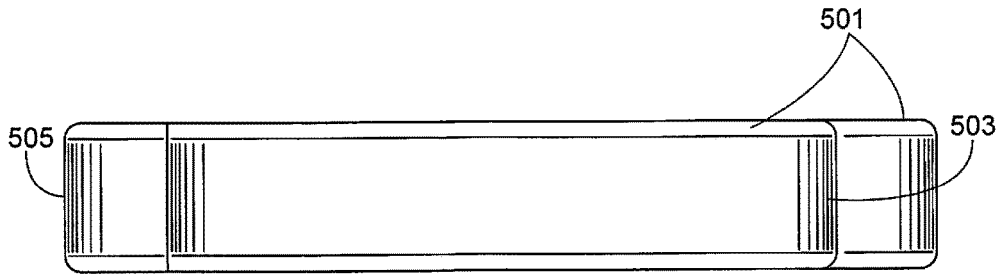
FIG. 5B shows a second side view of an apparatus according to one embodiment of the present invention.

FIGS. 5A and 5B show a top side view (5A) and bottom side view (5B) of an apparatus according to one embodiment of the present invention, showing terminal end 503 and curved end 505 of s-shaped body 501.

Figure 6:
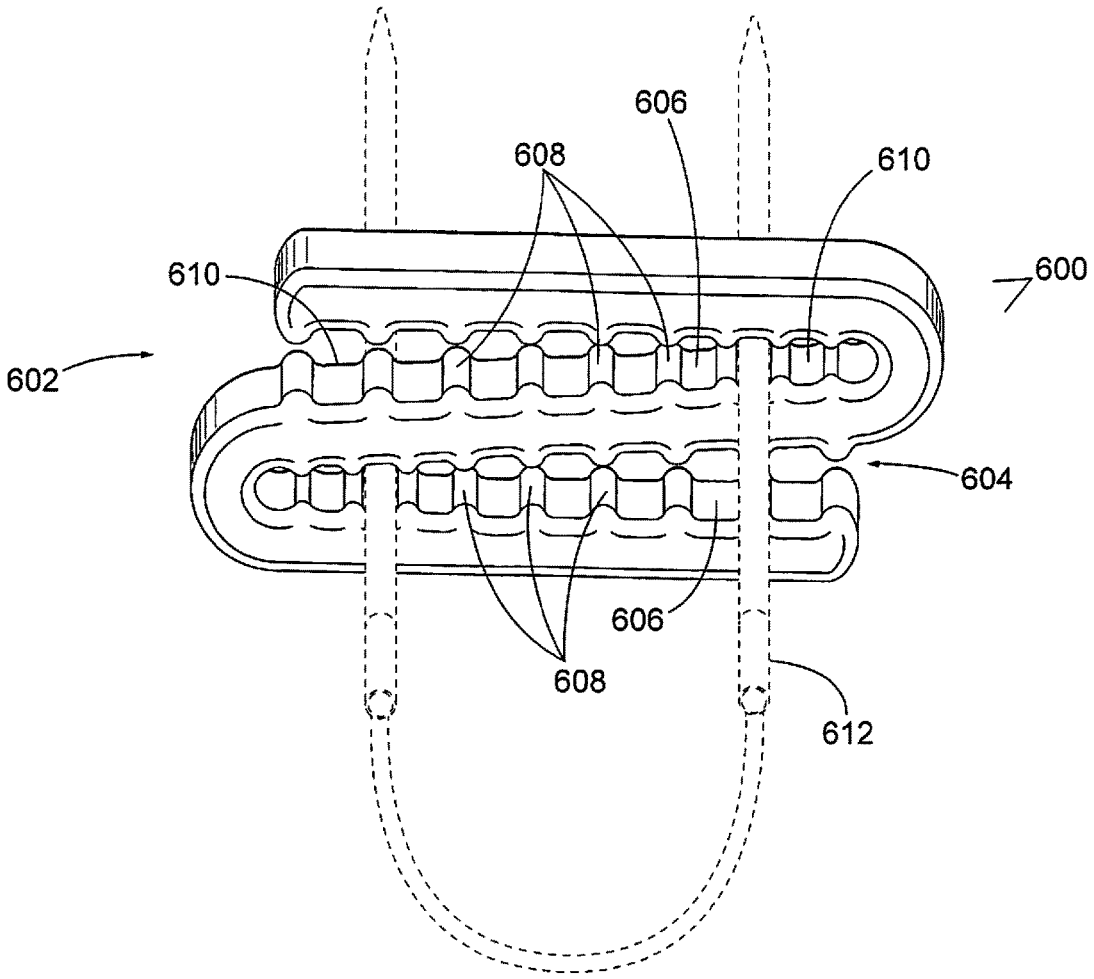
FIG. 6 shows a front side perspective view of an apparatus according to one embodiment of the present invention, and including a pair of knitting needles held in position by the apparatus.

FIG. 6 shows a front side perspective view of an apparatus 600 according to one embodiment of the present invention, and including a pair of knitting needles 612, held in position by the one or more needle compartments 610 formed by the plurality of radiused teeth 608 and the plurality of grooves 606. Note that while the figure shows a first knitting needle 612 held in position within the first inner channel 602, and a second knitting needle held in position within the second inner channel 604 of apparatus, both knitting needles could be arranged in a single channel.

Figure 7:
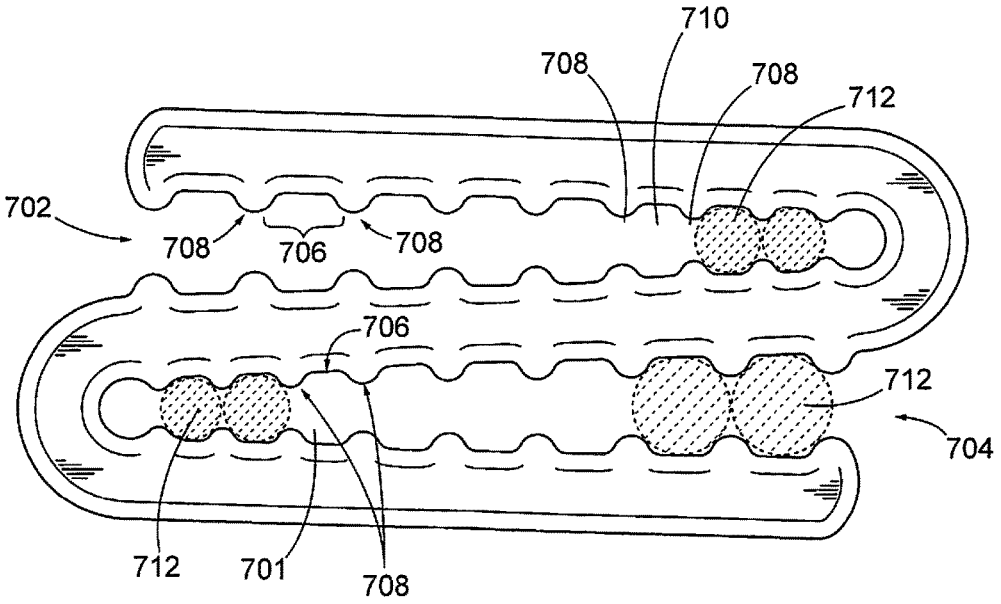
FIG. 7 shows a front perspective view of an apparatus according to one embodiment of the present invention, and showing a cross section of knitting needles of different gauges held in position by the apparatus.

FIG. 7 shows a front perspective view of an apparatus according to another embodiment of the present invention, and showing a cross section of knitting needles 712 of different gauges held in position by the one or more needle compartments 710 formed by the plurality of radiused teeth 708 and the plurality of grooves 706. Note that while the figure shows a first knitting needle 712 held in position within the first inner channel 702, and a second knitting needle held in position within the second inner channel 704 of apparatus, both knitting needles could be arranged in a single channel.

Figure 8:
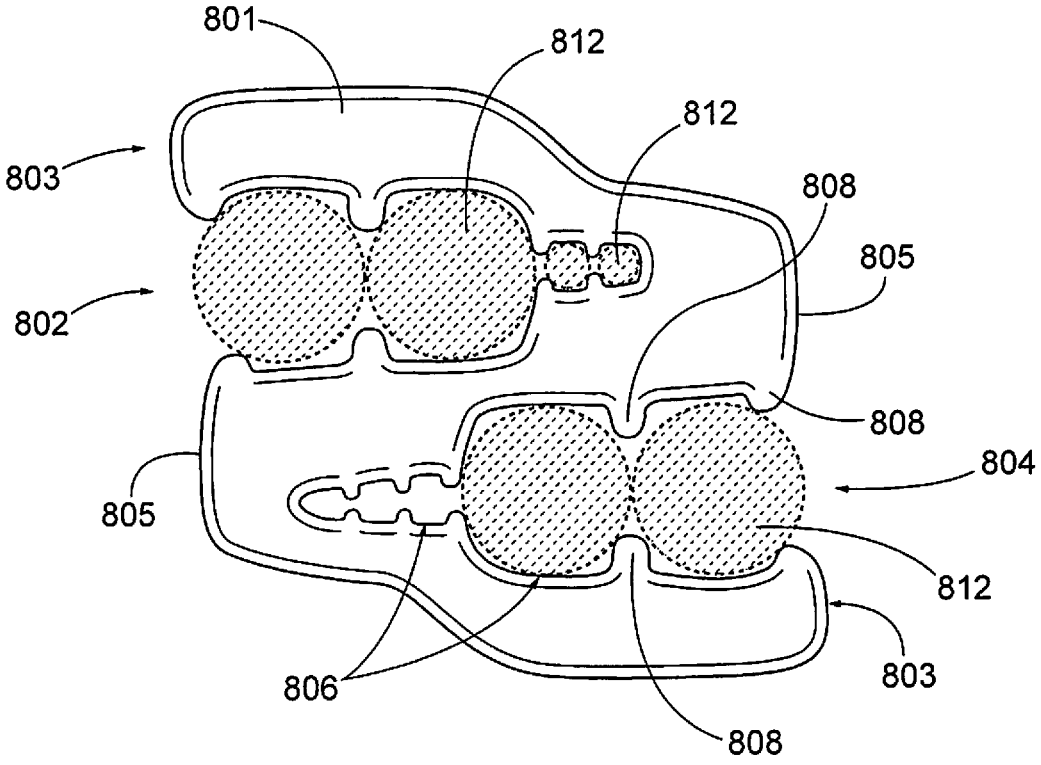
FIG. 8 shows a front perspective view of an apparatus according to another embodiment of the present invention, and showing a cross section of knitting needles of different gauges held in position by the apparatus.

FIG. 8 shows a front view of another embodiment of the invention, wherein apparatus 800 comprises a z-shaped body 801 (when viewed from a front side) configured with grooves 806 and radiused teeth 808 lining a portion of the surface of first inner channel 802 and second inner channel 804. In this particular arrangement, the size and quantity of the needle compartments 810 vary by the arrangement of grooves 806 and radiused teeth 808. For example, as shown in the figure, a first pair of knitting needles 812 of a smaller gauge (shown as a cross-section) are secured in needle compartment 810 of first channel 802, and a second pair of knitting needles 812 of a larger gauge are secured in needle compartment 810 of second channel 804.

Figure 9:
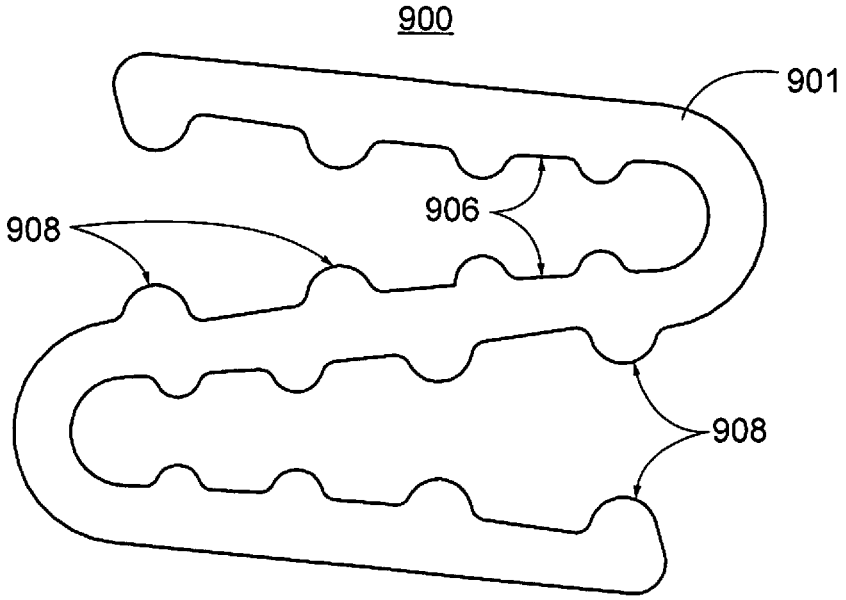
FIG. 9 shows a front perspective view of an apparatus according to another embodiment of the present invention, configured for various gauges of needles.

FIG. 9 shows a front view of another embodiment of the invention, wherein apparatus 900 comprises a z-shaped body 901 (when viewed from a front side) configured with grooves 906 and radiused teeth 908 lining a portion of the surface of body 901. In this particular arrangement, the size and quantity of the needle compartments 9 vary by the arrangement of grooves 906 and radiused teeth 908. For example, the figure is illustrative of a needle holder for approximately 1-4 pair of knitting needles of varying gauge.

Figure 10:
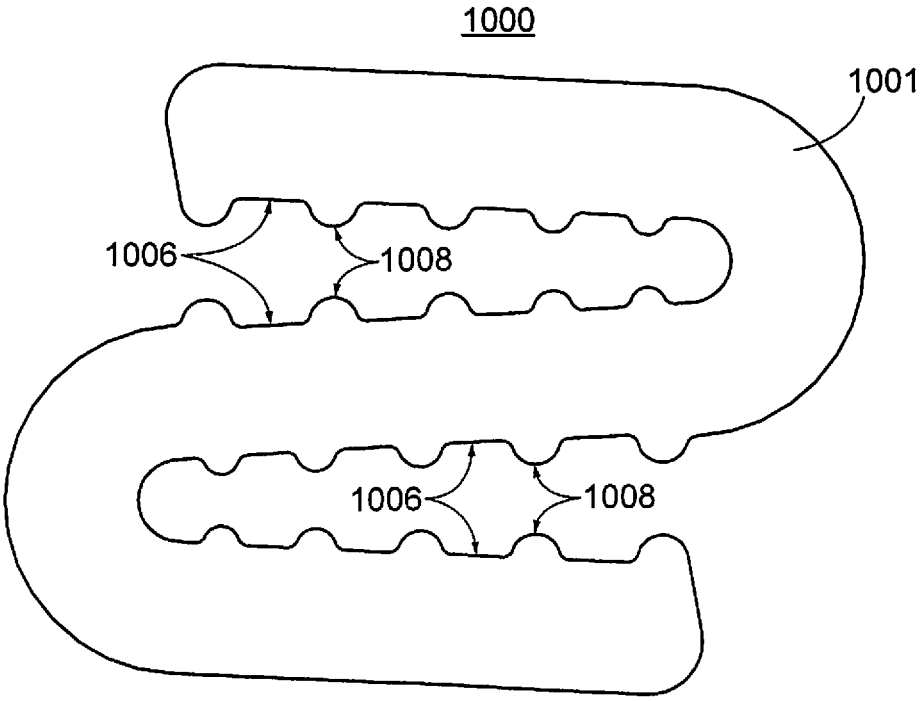
FIG. 10 shows a front perspective view of an apparatus according to another embodiment of the present invention.

FIG. 10 shows a front view of another embodiment of the invention, wherein apparatus 1000 comprises a z-shaped body 1001 (when viewed from a front side) configured with grooves 1006 and radiused teeth 1008 lining a portion of the surface of body 1001. In this particular arrangement, the size and quantity of the needle compartments vary by the arrangement of grooves 1006 and radiused teeth 1008. For example, the figure is illustrative of a needle holder for approximately 1-5 pair of knitting needles of varying gauge.

In one embodiment, the apparatus of the present invention is manufactured in part by a computer-controlled method and apparatus, for fabricating a three-dimensional (3-D) object according to the description herein, by building a multi-material or multi-color 3-D object directly from a computer-aided design of the object in a layer-by-layer, or a point-by-point fashion using a 3-D printing apparatus. In one embodiment, a method of manufacturing an apparatus for holding knitting needles comprises providing a 3D model such as a CAD file or system corresponding to the overall dimensions of the apparatus (overall length, width, height; groove depth or radius; etc.), exporting the model to a .STL file or other preferred file type for slicing software; running the file through a slicer program, which "slices" the model into individual layers to be printed, and creates the instructions that guide the 3D printer's nozzle through all of its movements (usually output in a .GCODE file format). This method allows the user to set the temperature of the nozzle (and print platform, if applicable as not all 3D printers have heated stages), the fill amount/density, the speed of the printer nozzle's motion, the rate of filament feed, and various other settings. Suitable filaments include either PLA (which prints at around 210° C.-225° C. nozzle temperature) or ABS (which prints at around 230° C.-245° C.) of various colors, or a wood fiber filament. The overall dimensions and instructions are all generated by the slicer software. Suitable 3D printers include FDM (Fused Deposition Modeling) type printers, and others such as SLA (steriolithographic).

In another embodiment, the apparatus as described herein is manufactured by an injection molding method. In one example, intended to be illustrative and not exhaustive, an injection molding method comprises a heating chamber configured with a nozzle, a clamping device, and one or more configurations of mold plates (one corresponding to an upper side of the apparatus and another corresponding to a lower side of the apparatus, with an additional runner plate) and other suitable materials, preferably thermoplastic materials, comprising raw materials for the apparatus to be manufactured. In one embodiment, the mold plates themselves may be either aluminum or stainless steel, or comprised of other suitable materials for injection molding. In one example, a method of manufacturing an apparatus of the present invention comprises placing a mold (arrangement of plates, such as a sprue plate, a runner plate, an upper apparatus plate and a lower apparatus plate, the upper and lower apparatus plate conforming to the dimensions, shape and arrangement of the apparatus to be manufactured) in a clamping fixture under (in the case of a vertically aligned mold machine) the injection chamber; providing thermoplastic beads or pellets in a heating chamber; once a critical temperature has been reached, using a piston (either manually operated or often times pneumatically actuated) to push melted plastic out of the nozzle and into the mold plates via the runner plate channel where it travels into the mold via holes in the runner plate, and where the melted thermoplastic material then cools and hardens into shape conforming to the shape provided by the mold plates. After cooling, the mold arrangement is removed from the clamping fixture, and the mold plates are separated. In one embodiment, finishing steps may include trimming excess plastic at the gates (the places the flow of plastic enters the part cavity in the mold).

It will be clear to a person skilled in the art that features described in relation to any of the embodiments described above can be applicable interchangeably between the different embodiments. The embodiments described above are examples to illustrate various features of the invention, and they are not exhaustive or exclusive.

Throughout the description and claims of this specification, the words "comprise" and "contain" and variations of them mean "including but not limited to", and they are not intended to (and do not) exclude other additives, components, materials or steps. Throughout, the singular encompasses the plural unless the context otherwise requires. In particular, where the indefinite article is used, the specification is to be understood as contemplating plurality as well as singularity, unless the context requires otherwise.

Features, materials, characteristics, described in conjunction with a particular aspect, embodiment or example of the invention are to be understood to be applicable to any other aspect, embodiment or example described herein unless incompatible therewith. The invention is not restricted to the details of any foregoing embodiments. The invention extends to any novel one, or any novel combination, of the features disclosed in this specification (including any accompanying claims, abstract and drawings), or to any novel one, or any novel combination, of the elements so disclosed. Throughout the description and claims of this specification, the words "comprise" and "contain" and variations of them mean "including but not limited to", and they are not intended to (and do not) exclude other moieties, additives, components, integers or steps. Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the "true" spirit and scope of the invention.

The invention claimed is:

1. An apparatus for securing knitting needles, comprising:

a curvilinear body, the body comprising three relatively linear segments of similar length, width and depth, aligned in the same plane, the first segment adjoining the second segment by a curved end disposed opposite a first terminal end of the first portion, and the second segment adjoining a third segment by a curved end, the curved end opposite a second terminal end of the third portion, the area surrounded by the first portion and second portion defining a first inner channel comprising an inner surface, and the area surrounded by the second portion and third portion defining a second inner channel comprising an inner surface;

a plurality of grooves disposed along a portion of the surface of first inner channel and second inner channel, specifically along a surface of the first portion that faces a surface of the second portion, and along a surface of the second portion that faces the surface of the first portion; also along a surface of the second portion that faces a surface of the third portion, and along the surface of the third portion that faces the surface of the second portion;

a plurality of protruding teeth formed where two grooves meet; and a plurality of needle containment compartments formed by opposing grooves opposite one another along the inner surface, and whereby the needle compartments are of a size commensurate for securing a knitting needle of a gauge essentially equal to the radius of the needle containment compartment formed by the opposing grooves.

2. The apparatus according to claim 1, wherein the protruding teeth have a radius ranging from approximately 0.029 inches up to approximately 0.046 inches.

3. The apparatus according to claim 1, wherein the needle compartments formed by alignment of grooves opposite one another have a distance between opposing grooves ranging from approximately 0.069 inches up to approximately 0.236 inches.

4. The apparatus according to claim 1, further comprising two, four, six, eight or up to ten pair of grooves per channel.

5. The apparatus according to claim 1, further comprising overall apparatus dimensions of a length ranging from approximately 1.0 inches to up to 3.0 inches.

6. The apparatus according to claim 1, comprising a range of two to up to twenty needle holder compartments.

* * * * *